United States Patent [19]

Ueda et al.

[11] 4,432,197

[45] Feb. 21, 1984

[54] METHOD FOR PREVENTING ABNORMAL SPLICING IN WINDER

[75] Inventors: Yutaka Ueda, Nara; Isamu Ikeda, Kyoto, all of Japan

[73] Assignee: Murata Kikai Kabusiki Kaisha, Kyoto, Japan

[21] Appl. No.: 329,386

[22] Filed: Dec. 10, 1981

[30] Foreign Application Priority Data

Dec. 13, 1980 [JP] Japan ..... 55-176306

[51] Int. Cl.[3] ..... D01H 15/00

[52] U.S. Cl. ..... 57/261; 57/22; 57/264

[58] Field of Search ..... 57/22, 23, 261, 262, 57/263, 264

[56] References Cited

U.S. PATENT DOCUMENTS

| | | | |
|---|---|---|---|
| 4,217,749 | 8/1980 | Rohner et al. | 57/22 X |
| 4,232,509 | 11/1980 | Rohner et al. | 57/22 X |
| 4,240,247 | 12/1980 | Matsui et al. | 57/22 X |
| 4,246,744 | 1/1981 | Matsui et al. | 57/22 |
| 4,314,437 | 2/1982 | Rohner et al. | 57/261 X |
| 4,344,277 | 8/1982 | Rohner et al. | 57/22 |

*Primary Examiner*—Donald Watkins

*Attorney, Agent, or Firm*—Spensley, Horn, Jubas & Lubitz

[57] ABSTRACT

A method for preventing abnormal splicing. When two or more yarns are sucked from the package by the suction arm or when a slab or other disorder is detected by the detecting device, the yarn is cut in response to a yarn cutting signal from the detecting device, and after completion of the splicing operation, the yarn is forcibly cut again and the splicing operation is conducted again.

8 Claims, 17 Drawing Figures

FIG. 1-a
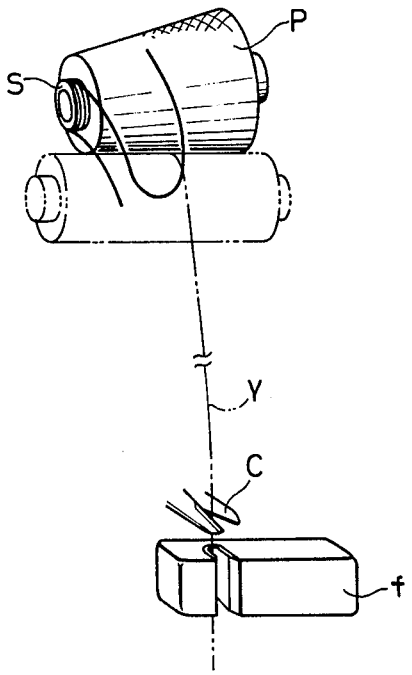
FIG. 1-b
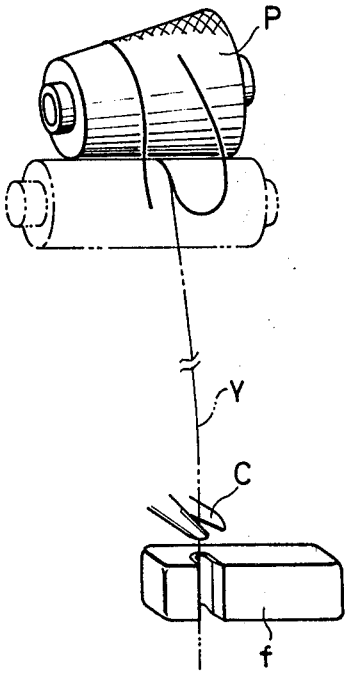
FIG. 2-a
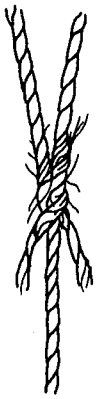
FIG. 2-b
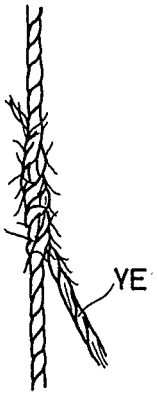

FIG. 7-a
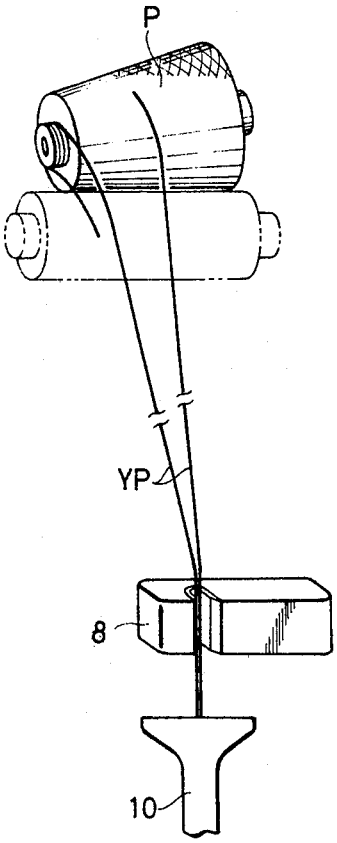
FIG. 7-b
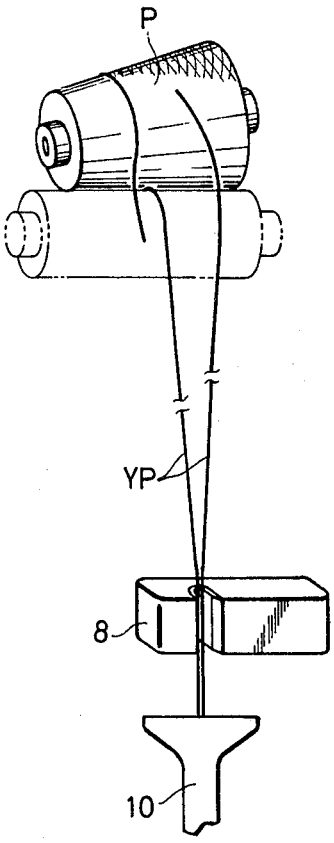

METHOD FOR PREVENTING ABNORMAL SPLICING IN WINDER

BACKGROUND OF THE INVENTION

For performing the splicing operation in a winder, there are adopted a fisherman's knot splicing apparatus, a weaver's knot splicing apparatus and a fluid type splicing apparatus for performing the splicing operation by the action of a compressed fluid. Each of these known splicing apparatuses is arranged in a yarn passage of a winder, and a yarn to be wound during the normal rewinding operation is taken out from a yarn feed bobbin, passed above the splicing apparatus while being always checked by a detecting device and wound on a package by a positively rotated friction roller. When breakage of the yarn or a slub or other disorder is detected during the rewinding operation by the detecting device arranged between the splicing apparatus and the yarn feed bobbin, a splicing signal is immediately issued in case of yarn breakage or the yarn is once cut by a cutter on detection of the slub or the like and a splicing signal is then issued, and the splicing operation is performed by the splicing apparatus.

In the above splicing operation, when winding is stopped in response to the splicing signal from the detecting device and when the package is rotated in the reverse direction and the yarn end is sucked by a first suction arm, normally, one yarn end is sucked by the first suction arm and a second suction arm sucks the end of the yarn from the yarn feed bobbin, and the splicing operation is performed by the splicing apparatus to restore the normal rewinding state. However, according to the state of winding of the yarn end on the package, it sometimes happens that suction of the yarn end is impossible or a plurality of yarn ends are simultaneously sucked and taken out. This undesirable phenomenon can take place at any time when yarn breakage is caused during the rewinding operation whether the yarn breakage may be natural yarn breakage or yarn breakage caused by a cutter.

As shown in FIGS. 1-*a* and 1-*b*, when the presence of a slub in a running yarn Y is detected by a detecting device f, the yarn is cut by a cutter C arranged in the vicinity of the detecting device f. Since an appropriate tension is given to the running yarn Y during the rewinding operation and is wound on a package P in this state, if the yarn Y is thus cut by the cutter C, by reaction of the tension or the like, falling on the end face is caused, that is, as shown in FIG. 1-*a*, the yarn end is entangled with a cop portion S on the end face, or as shown in FIG. 1-*b*, the yarn end is wound around the periphery of the package P, and travelling of the yarn is stopped in this state. A similar phenomenon takes place also in case of natural yarn breakage.

If the first suction arm (not shown) is turned in this state to effect suction of the yarn end, there is a fair chance that two or more yarns are simultaneously taken out. In order to prevent occurrence of this undesirable phenomenon, there is disposed a step of checking whether or not one yarn end is normally taken out from the package P by the first suction arm, before actuation of the second suction arm. This checking is performed by the above-mentioned detecting device for detecting a slub or the like, or a different checking device may be disposed independently. When one yarn end is normally taken out, the yarn is taken out from the yarn feed bobbin by the second suction arm and the splicing operation is carried out.

On the other hand, when two or more of yarn ends are taken out, the cutting operation is conducted again by the cutter C, and then, the normal splicing operation is performed.

When the cutting operation is thus performed by the cutter C, since the yarn end on the side of the package P is rendered free, in the above-mentioned mechanical splicing apparatus, the splicing operation ends in a failure in most cases, and only when one yarn end is normally taken after repeating failures in the splicing operation several times, for example, twice or third times, the splicing operation is accomplished and the normal rewinding state is restored.

In case of the fluid type splicing apparatus, even if the yarn end on the side of the package P is free, the yarn end is sucked in the splicing zone and the splicing operation is often accomplished. For example, when two yarn ends are sucked as shown in FIGS. 2-*a* and 2-*b*, these yarn ends are spliced in the bifurcate state as shown in FIG. 2-*a*, or even when one yarn end is taken out, if the yarn is cut on detection of a slub or other disorder, the splicing operation is carried out in the state where the splicing length is not set on the free end side, and therefore, as shown in FIG. 2-*b*, the normal rewinding state is restored while leaving one yarn end YE as it is as shown in FIG. 2-*b*.

It may be considered that the above disadvantage will be overcome if there is adopted a mechanism in which when cutting is effected on detection of disorder, the subsequent splicing operation is not immediately performed. However, in this case, the structure becomes complicated, and since the frequency of occurrence of the above phenomenon is not so high, provision of such special mechanism is not economically advantageous.

SUMMARY OF THE INVENTION

The present invention relates to a method for preventing abnormal splicing during the splicing operation in a winder. More particularly, the present invention relates to a method for preventing abnormal splicing when a fluid-type splicing apparatus is applied.

An object of the present invention is to prevent direct restoration of the rewinding state when abnormal splicing, that is, two yarn ends are spliced in the bifurcate state or they are spliced leaving one yarn end free, takes place.

According to the present invention, during the splicing operation at the start of the rewinding operation and also during the splicing operation when the yarn is cut on detection of a slub or the like at the rewinding operation, when two or more yarns are sucked from the package by the suction arm or when a slub or other disorder is detected by the detecting device, the yarn is cut in response to a yarn cutting signal from the detecting device, and just after completion of the splicing operation, the yarn is forcibly cut again in response to a yarn cutting signal fed from the outside through a timer and the splicing operation is conducted again. Accordingly, in the present invention, performance of the rewinding operation in the defective splicing state is prevented.

BRIEF DESCRIPTION OF DRAWINGS

FIGS. 1-*a* and 1-*b* are diagrams illustrating undesirable state of winding of the yarn end on the package.

FIGS. 2-*a* and 2-*b* are diagrams illustrating splicing states in case of an abnormal yarn.

FIGS. 7-*a* and 7-*b* are diagrams illustrating the sucking state in case of an abnormal yarn.

DETAILED DESCRIPTION OF THE INVENTION

The present invention will now be described in detail with reference to embodiments illustrated in the accompanying drawings.

Figure 3:
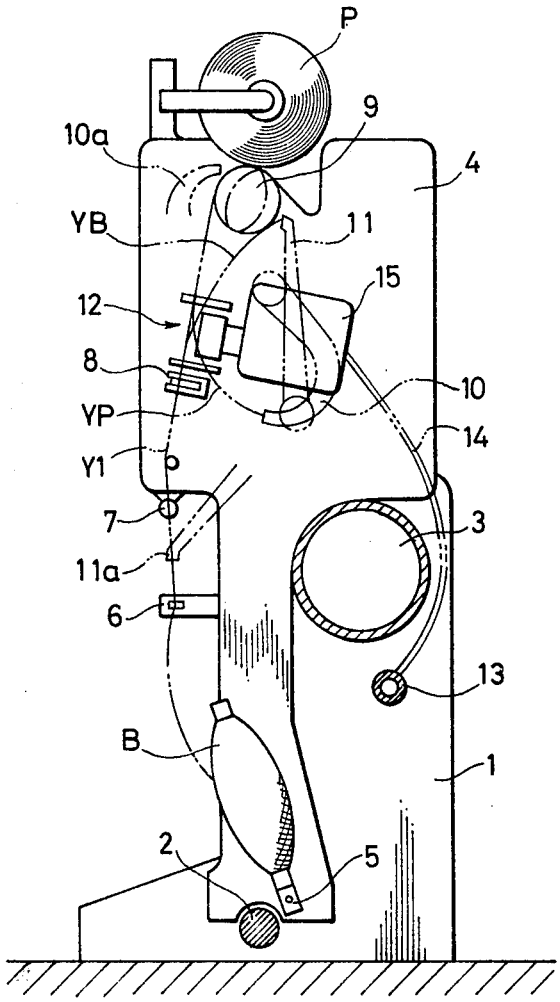
FIG. 3 is a side view diagramatically illustrating the structure of the winder.

FIG. 3 is a schematic diagram showing an automatic winder to which the present invention is applied. A supporting shaft 2 and a suction pipe 3 are laid out between side frames 1, and a winding unit 3 is rotatably supported on the shaft 4. During the operation of the automatic winder, the unit 4 is loaded also on the suction pipe 3 and is appropriately secured.

The suction pipe 3 is connected to a blower (not shown) and a sucking current stream always acts on the suction pipe 3.

In the above-mentioned winding unit 4, rewinding of a yarn from a bobbin B to a package P is performed in the following manner. Namely, a yarn Y1 is taken out from the bobbin B on a peg 5 through a guide 6, and an appropriate tension is given to the yarn Y1 by a tenser 7. Then, the yarn Y1 is passed through a detecting device 8 for performing cutting when a yarn unevenness exceeding the allowable range, such as a slub, is detected and also performing detection of the running yarn, and the yarn Y1 is then wound on the package P rotated by a winding drum 9.

When the detecting device 8 detects a slub or the like in the yarn, a cutter arranged in the vicinity of the detecting device 8 is actuated to cut the running yarn Y1 and the winding operation is stopped. Separately, a first yarn guide suction arm 10 is actuated to guide the yarn YP on the side of the package P to a splicing apparatus 12 located at a position apart from the normal yarn passage Y1 and a second yarn guide suction arm 11 is actuated to guide the yarn YB on the side of the bobbin B to the splicing apparatus 12. After the splicing operation is accomplished by the splicing apparatus 12, rewinding of the yarn is conducted again.

The first and second suction arms 10 and 11 are connected to the suction pipe 3, and since a compressed fluid such as compressed air is used for the splicing apparatus 12, a conduit 14 is laid out between another pipe 13 and a splicing box 15 and the compressed fluid is supplied from this pipe 13.

Figure 4:
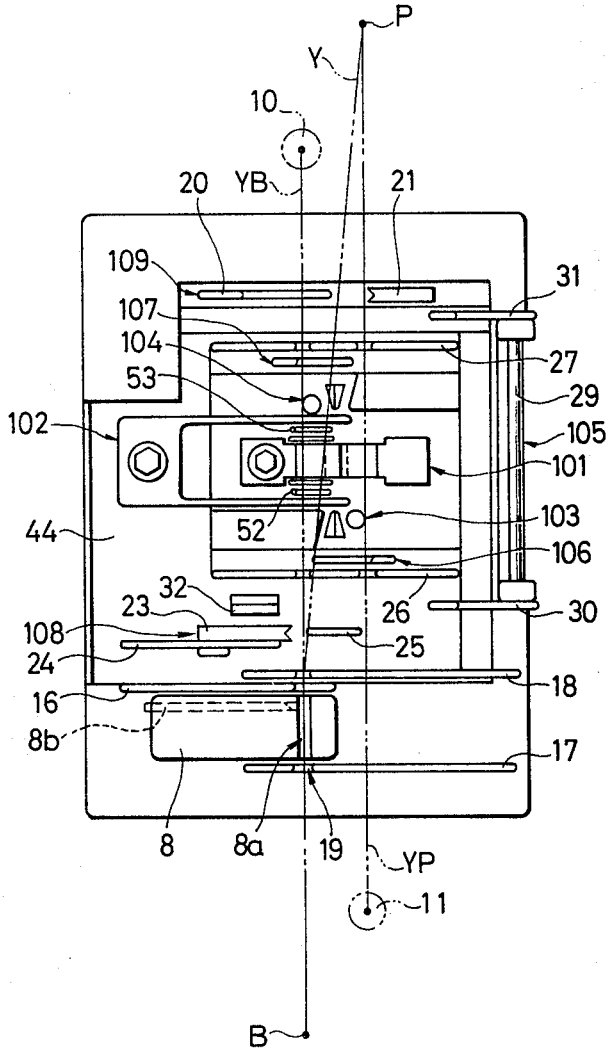
FIG. 4 is a side view of the splicing apparatus.
Figure 5:
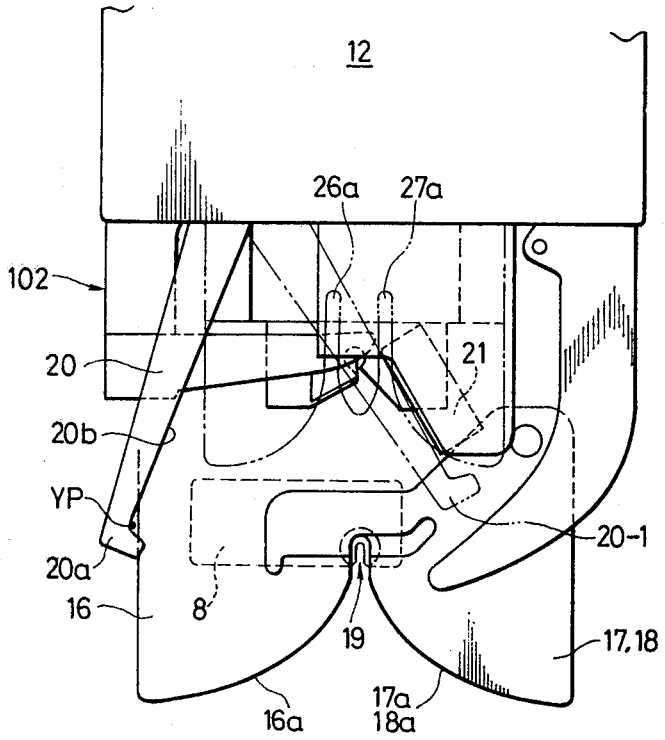
FIGS. 5 and 6 are plan views of the splicing apparatus.
Figure 6:
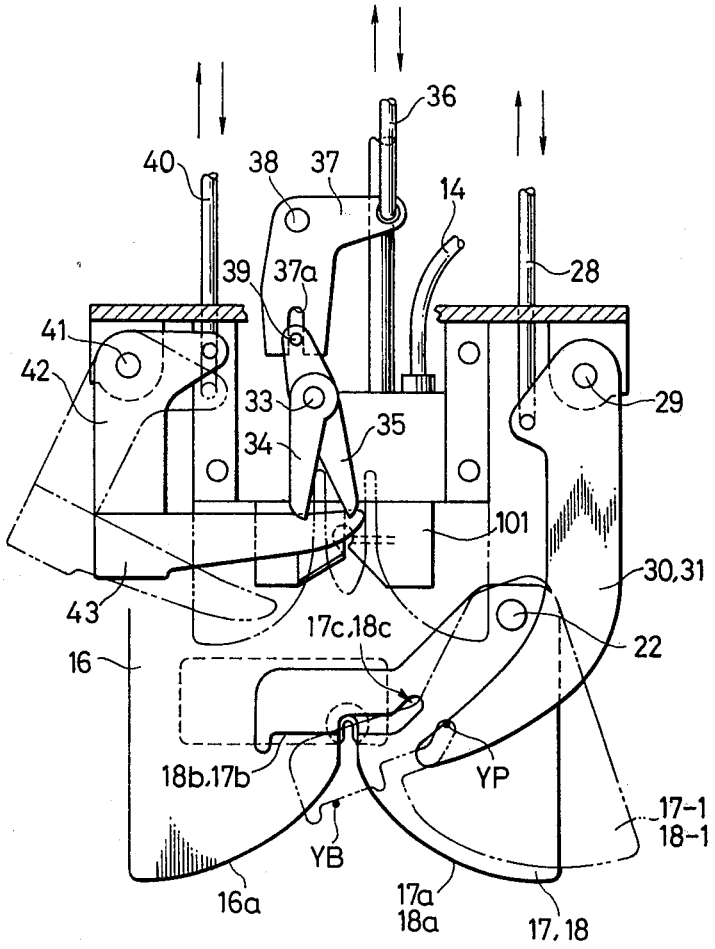

The entire structure of the splicing apparatus 12 is illustrated in detail in FIGS. 4 through 6. During the normal rewinding operation, the yarn Y is taken out from the bobbin B, passed through the detecting device 8, a stationary guide 16 arranged on one end of the detecting device 8 and turning guides 17 and 18 arranged on both the sides of the detecting device 8, and guided above the splicing apparatus 12 to the package P.

In principle, the splicing apparatus 12 comprises a splicing member 101 located substantially at the center, a clamping device 102 arranged on the side of the splicing member 101 and expanded in a bifurcate manner to both the sides of the splicing member 101, yarn control nozzles 103 and 104 arranged on both the sides of the bifurcate portion of the clamping device 102, a yarn gathering lever 105 arranged to confront the clamping device 102 through the intervening splicing member 101, yarn cutting devices 106 and 107 arranged outwardly of the control nozzles 103 and 104, and yarn supporting devices 108 and 109 arranged outwardly of the cutting devices 106 and 107 to support the yarn YB on the side of the bobbin B and the yarn YP on the side of the package P, respectively. In the splicing operation, the first and second suction arms 10 and 11 shown in FIG. 3 are turned and moved above the splicing apparatus 12 while intersecting each other, and they suck the yarns YB and YP on the sides of the bobbin B and package P and they move to the outside of the splicing apparatus 12 and stop there.

The first and second suction arms 10 and 11 are not simultaneously operated but are operated with a certain time lag. More specifically, at first, the yarn YP on the side of the package P is turned and moved to the outside of the splicing apparatus 12 and detecting device 8 by the first suction arm 10 and is fitted in a guide groove 19 while being guided by inclined guide faces 16*a*, 17*a* and 18*a* of the stationary guide 16 and turning guides 17 and 18. The detecting device 8 arranged between the guide faces 16*a* and 17*a* and having a detecting portion 8*a* located at the same position as that of the guide groove 19 confirms whether or not the yarn YP is present and whether or not two or more of yarn YP are erroneously sucked by the first suction arm 10 as shown in FIGS. 7-*a* and 7-*b*. After such confirmation, the turning guides 17 and 18 are turned in the counterclockwise direction with a supporting shaft 22 being as the fulcrum by control cams (not shown), and the yarn YP is separated from the detecting device 8 and fitted in escape grooves 17*c* and 18*c* of the turning guides 17 and 18.

Substantially simultaneously with the turning movement of the turning guides 17 and 18, a turning lever 20 of the yarn supporting device 109 on the side of the package P is turned in a counterclockwise direction to a position 20-1 indicated by a chain line by control cams (not shown) as shown in FIG. 5, and is stopped by impingement against a supporting block 21 secured at a constant position. At this time, the yarn YP is hung on a hook portion 20*a* of the turning lever 20 and is moved along a guide face 20*b* in a direction separating from the hook portion 20*a*. Thus, the yarn YP is gripped between the supporting block 21 and the guide face 20*b* of the turning lever 20.

The yarn YB on the side of the bobbin B is sucked by the second suction arm 11 and the second suction arm 11 is turned in a direction opposite to the turning direction of the first suction arm 10 to the outside of the splicing apparatus 12 and stopped there. Substantially simultaneously with stopping of the second suction arm 11, a supporting plate 23 of the yarn supporting device 108 on the side of the bobbin B is moved along a guide plate 24 in the same direction as the moving direction of the turning lever 20 by control cams (not shown) while the yarn YB is hung on the supporting plate 23. The supporting plate 23 is stopped by impingement against a supporting block 25 secured at a constant position and the yarn YB is gripped between the supporting plate 23 and the supporting block 25.

At this time, since the yarn YB is passed through the turning guides 17 and 18 while they are turned to the positions 17-1 and 18-1 as shown in FIG. 6, the yarn YB is hung and supported on hook portions **17*b* and 18*b* near the top ends of the guides 17 and 18. Checking by the detecting device 8** is performed after completion of the splicing operation.

When the yarn YB on the side of the bobbin B and the yarn YP on the side of the package P are supported by the yarn supporting devices 108 and 109, respectively, the yarn gathering lever 105 is turned to guide the yarns YP and YB simultaneously toward the splicing member 101, and the yarns YP and YB are introduced into guide grooves **26*a* and 27*a* of fork guides 26 and 27 disposed outside the yarn cutting devices 106 and 107, respectively and they are guided into a splicing hole, described hereinafter, of the splicing member 101**.

The yarn gathering lever 105 guides the yarns YP and YB into guide grooves **26*a* and 27*a* by advance and retreat of a rod 28 and clockwise turning of levers 30 and 31 secured integrally with a supporting shaft 29 with said shaft 29 being as the fulcrum. The turning range of the yarn gathering lever 105 is important for setting the splicing length and the turning movement of the yarn gathering lever 105 is regulated by impingement against a stopper 32 having a V-shaped section, which is arranged between the fork guide 26 and the yarn supporting member 108. Accordingly, the turning range of the yarn gathering lever 105 can be adjusted by adjusting the position of the stopper 32**.

In this state, the yarn cutting devices 106 and 107 are actuated by control cams (not shown) to effect cutting of the yarn YP and YB, and the yarn lengths from the yarn supporting devices 108 and 109 supporting the yarns YP and YB are set.

Each of the yarn cutting devices 106 and 107 has scissors, and a moving blade 35 is turned with a stationary pin 33 being as the fulcrum so that the moving blade 35 intersects a stationary blade 34, whereby cutting of the yarn is accomplished.

The moving blade 35 is constructed so that a rod 36 is advanced or retreated by control cams (not shown) and a bifurcate lever 37 is turned in the clockwise or counterclockwise direction with a shaft 38 being as the fulcrum to cause a form portion **37*a* of the bifurcate lever 37 to move a supporting pin 39 on the other end of the moving blade 35, whereby the moving blade 35** is operated.

When the first suction arm 10 sucks two or more of yarns YP as shown in FIGS. **7-*a* and 7-*b* or when the detecting device 8 senses a slub or other disorder, a cutter 8*b* installed in the detecting device 8** is actuated to effect cutting of the yarn.

Even if the above yarn cutting operation is performed, the above-mentioned splicing operation is conducted, and the yarn YB on the side of the bobbin B is cut by the yarn cutting device 107 as in the normal splicing operation and the yarn length from the yarn supporting device 108 is set. However, the yarn YP on the side of the package P comes to have a free end, and therefore, the yarn YP is not cut by the yarn cutting device 106 or if the yarn YP is cut, the yarn length from the yarn supporting device 109 is not precisely set. Accordingly, even if the splicing operation is performed by the splicing member 101 described hereinafter, the above-mentioned undesirable phenomenon as shown in FIG. **2-*a* or 2-*b*** is caused to occur.

Of course, the undesirable phenomenon takes place also in case of natural yarn breakage. If winding on the package P is conducted in this abnormal splicing state, the doffed package P is a defective package, and if such package is not picked up as a defective package, the subsequent knitting or weaving step is adversely influenced.

In order to prevent rewinding on the package P in such abnormal splicing state, just after initiation of rewinding on the package P, the yarn is forcibly cut again, and the yarns YP and YB are sucked by the first and second suction arms 10 and 11 and the splicing operation is carried out. At this time, if disorder is detected by the detecting device 8 again, the yarn is forcibly cut again and the above operations are repeated until the normal splicing operation is accomplished. In the worst case, by entanglement of the yarn with the package P or for other reason, it is rendered impossible to take out the yarn end by the suction arm 10. Accordingly, when normal splicing is not accomplished even if the splicing operation is repeated several times, the splicing operation is stopped and a stop signal or the like is displayed.

Figure 8:
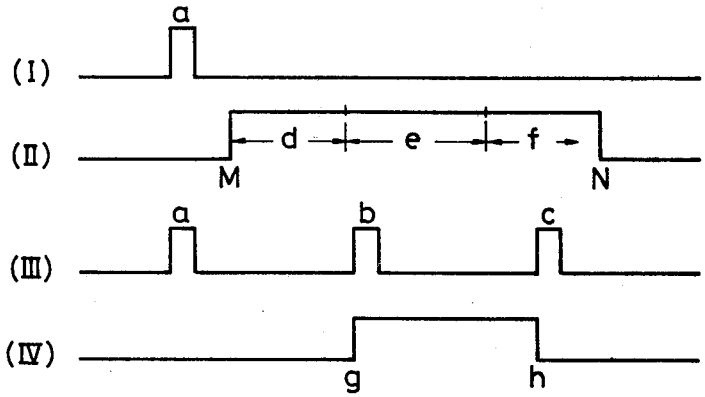
FIG. 8 is a timing diagram of the splicing operation.
Figure 9:
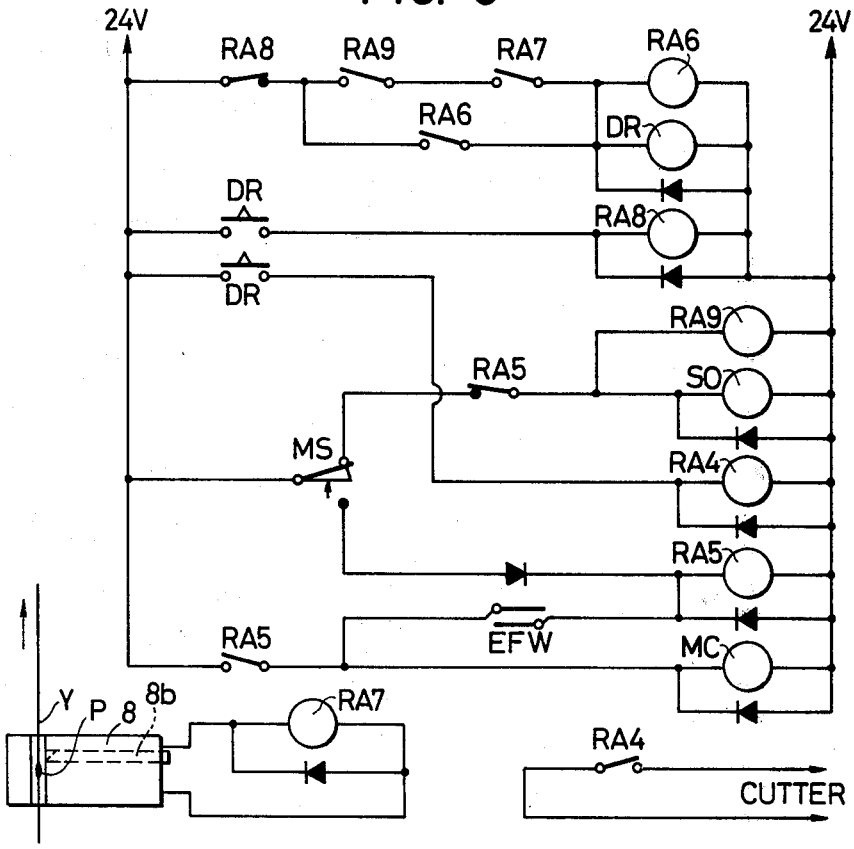
FIG. 9 is a diagram of an electric circuit for the splicing operation.

More specifically, referring to a timing diagram of FIG. 8 and an electric circuit diagram of FIG. 9, when a start button for initiation of the rewinding operation is put on, a solenoid SO is actuated to operate a one-rotation clutch (not shown), and various control cams are operated through said clutch, whereby the yarn sucking operation (zone d) and splicing operation (zone e) of the suction arms 10 and 11 are performed between points M and N shown in FIG. 8-(II). Just after the splicing operation, one of the control cams kicks a microswitch MS to close a contact A of a relay RA5 and also close a contact (not shown) of a relay MC, whereby the winding drum 9 is started and rewinding on the package P is initiated.

Substantially simultaneously with initiation of the above rewinding operation, the yarn Y is inserted into the detecting device 8 and is travelled therein. By this yarn travel, a yarn travel feeler EFW is closed and even if the microswitch MS is turned off, the contact A of the relay RA5 is kept closed and a contact B of the relay RA5 is opened by self-retention.

When a slub P or the like is detected by the detecting device 8 during the rewinding operation, the yarn is cut at a point a shown in FIG. 8-(I) by the cutter **8*b* installed in the detecting device 8**. By this cutting of the yarn, the yarn travel feeler EFW is opened, and the contact A of the relay RA5 is opened and simultaneously, the contact B of the relay RA5 is closed, whereby the solenoid SO is actuated to perform the normal splicing operation.

In the above splicing operation, when the first suction arm 10 sucks the yarn YP on the side of the package P and inserts it into the detecting device 8, if the presence of two or more of yarns YP or a slub P or other disorder is detected, just after actuation of the suction arm 10, in response to a yarn cutting signal from the detecting device 8, the cutter **8*b* is actuated to cut the yarn again at a point b shown in FIG. 8**-(III).

If the yarn is cut during the splicing operation, contacts of relays RA7 and RA9 are closed to actuate a timer DR, and after passage of a predetermined time, a contact DR of the timer is closed and a contact of a relay RA8 is opened, and simultaneously, a contact of a relay RA4 is closed to emit a yarn cutting signal. Forcible cutting of the yarn is performed by the cutter **8*b*** just after the start of the winding drum after completion of the splicing operation.

Incidentally, the contact of the relay RA7 is instantaneously closed only when the cutter **8*b*** is actuated. At this time, a contact of a relay RA6 is closed, and self-retention is maintained even after the contact RA7 is opened.

Referring to FIG. 8, in the normal splicing operation, when a slub or the like is detected by the detecting device 8, the yarn is cut at the point a shown in FIG. 8-(I), and after cutting of the yarn, between the points M and N shown in FIG. 8-(II), splicing is performed by a series of the operations, that is, the operation of sucking the yarn ends from the package P and bobbin B by the first and second suction arms 10 and 11 (zone d), the knotting operation (zone e) and the operation of starting the winding drum (zone f), and rewinding is initiated.

When the end of the yarn on the side of the package P is sucked by the first suction arm 10, if the detecting device 8 detects suction of two or more of yarn ends or a slub or disorder exceeding the allowable range, the cutter **8*b* installed in the detecting device 8 is actuated again to cut the yarn at the point b shown in FIG. 8**-(III).

Even if this yarn cutting operation is performed, the splicing operation between the points M and N shown in FIG. 8-(II) is continued, and after the splicing operation has been completed (zones d and e), the drum is started (zone f) and rewinding on the package P is initiated.

When the yarn cutting operation is carried out at the point b shown in FIG. 8-(III) while the splicing operation is continued, defective splicing as shown in FIG. 2-*a* or 2-*b* is caused, and therefore, when the yarn is cut at the point b shown in FIG. 8-(III), after the yarn cutting at the point b, forcible yarn cutting is performed at the point c shown in FIG. 8-(III) through the timer shown between points g and h in FIG. 8-(IV). The timer is set so that cutting of the yarn at the point c shown in FIG. 8-(III) is effected just after starting of the winding drum.

When forcible cutting of the yarn at the point c shown in FIG. 8-(III) is thus performed, the normal splicing operation is conducted again and rewinding on the package P is started.

Figure 10:
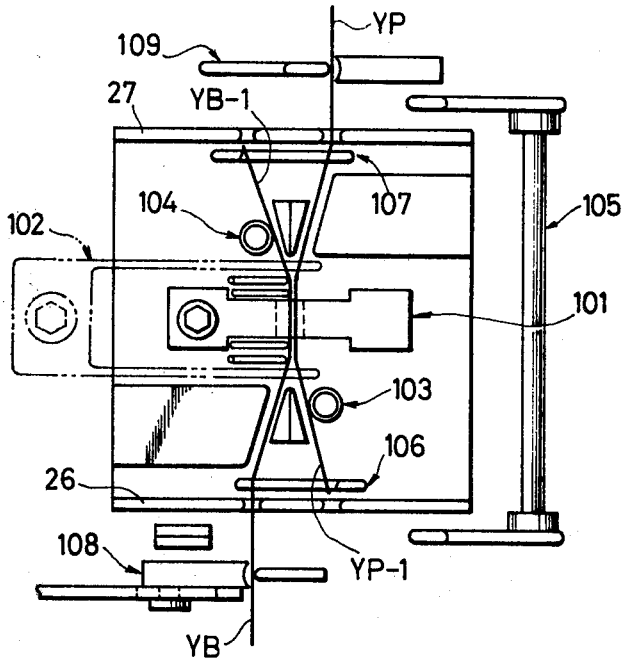
FIG. 10 is a partically enlarged view of the splicing apparatus.

In the above-mentioned splicing operation, as shown in FIG. 10, the yarn YP on the side of the package P and the yarn B on the side of the bobbin B are cut by the yarn cutting devices 106 and 107, and the yarn lengths from the yarn supporting devices 108 and 109 are set and the yarn gathering lever 105 is turned and returned to the original position. Substantially at the same time, the yarn ends YP-1 and YB-1 are sucked in the control nozzles 103 and 104 by the sucking actions of the control nozzles 103 and 104 and the yarn ends YP-1 and YB-1 are untwisted so as to produce a state suitable for splicing.

Then, the yarn gathering lever 105 is turned again to gather the yarn ends YP-1 and YB-1 to the splicing hole of the splicing member 101 described hereinafter by the control nozzles 103 and 104. Simultaneously, the yarn ends YP-1 and YB-1 are clamped by the clamping device 102 and the overlapped yarn ends YP-1 and YB-1 undergo the action of the compressed fluid and splicing is performed. At this time, in the clamping device 102, as shown in FIG. 6, a clamp plate 43 screwed to a turning lever 42 is turned with a shaft 41 secured at a constant position being as the fulcrum by advance and retreat of a rod 40 by control cams (not shown), whereby the clamping operation is performed.

The clamping operation of the clamping plate 43 is effective for preventing abnormal untwisting of the yarn by balloons formed on the yarn ends YP-1 and YB-1 by the action of the compressed fluid at the time of splicing and also for regulating the positions of both the yarn ends. Accordingly, splicing can be performed stably by virtue of this clamping operation of the clamping plate 43.

Figure 11:
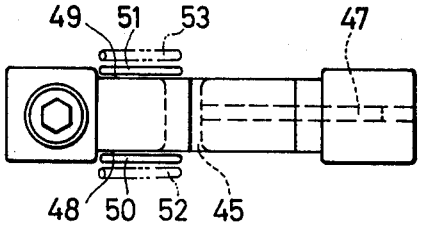
FIG. 11 is a plan view of the splicing member.
Figure 12:
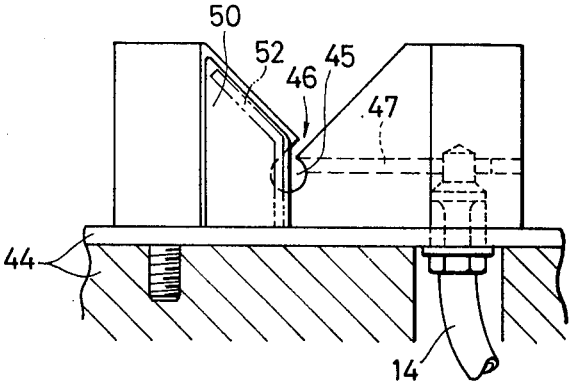
FIG. 12 is a side view of the splicing member.

The splicing member 101 is illustrated in FIGS. 11 and 12. The splicing member 101 located substantially at the center of the splicing apparatus 12 is secured to a bracket 44, and a splicing hole 45 having a cylindrical shape is formed substantially at the center of the splicing member 101 and a slit 46 suitable for insertion of the yarn Y from the outside is formed entirely in the tangential direction on the splicing hole 45. Furthermore, a jetting nozzle 47 opened in the tangential direction is formed and the compressed fluid is supplied to the jetting nozzle 47 through the conduit 14 described hereinbefore.

Balloon controlling plates 50 and 51 are secured on both the sides of the splicing member 101 through spacers 48 and 49. The control plates 50 and 51 cover about ½ of the sectional area of the splicing hole 45 to control ballooning at the splicing operation.

Stationary pins 52 and 53 projected on both the sides of the control plates 50 and 51 exert a function of assisting regulation of the position of the yarn when the clamping plate 43 of the clamping device 102 is turned to clamp the yarn.

Figure 13:
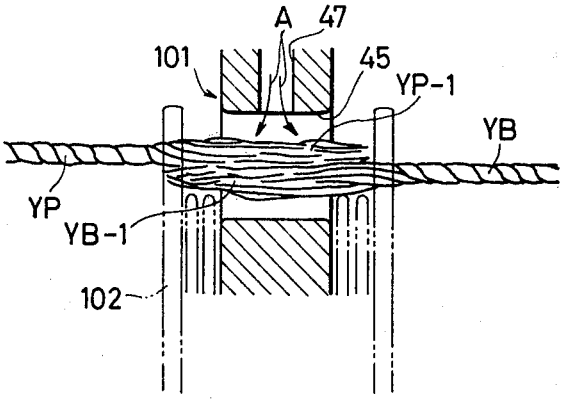
FIG. 13 is a partially enlarged view of the splicing member.
Figure 14:
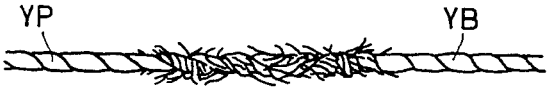
FIG. 14 is a diagram illustrating the splicing state.

As shown in FIG. 13, the untwisted yarn ends YP-1 and YB-1 are overlapped together in the splicing hole 45 of the splicing member 101 and are clamped by the clamping device 102. In this state, the yarn ends YP-1 and YB-1 are subjected to the action of a compressed fluid A jetted from the jetting nozzle 47, and splicing is accomplished as shown in FIG. 14.

In the foregoing description, the fluid type splicing method for performing splicing by utilizing a compressed fluid has been illustrated. Of course, in the present invention, there may be adopted a mechanical splicing method for forming fisherman's knots or weaver's knots.

In the foregoing embodiment, a signal from the slab catcher is fed to a different circuit to effect the intended control. In the present invention, there may be adopted a method in which an adaptor capable of exerting the above function is built in the slub catcher and the intended control is similarly effected.

What is claimed is:

1. A method for preventing abnormal splicing in a winder, in which a yarn taken out from a bobbin through a guide is given an appropriate tension by a tenser, passed through a detecting device for performing detection and cutting of uneven yarn and for performing detection of the runningg yarn, and then wound on a package, characterized in that a first yarn guide suction arm for a yarn on a package side, a splicing apparatus located at a position apart from the normal yarn passage and a second yarn guide suction arm for a yarn on a bobbin side are arranged along the yarn passage and when a plurality of yarn ends sucked by the first suction arm or a slub or other disorder exceeding the allowable range are detected by the detecting device during the splicing operation, a cutter of the detecting device is actuated by a yarn cutting signal from the detecting device to cut the yarn and the yarn is forcibly cut again just after completion of the splicing operation in response to a yarn cutting signal fed from the outside through a timer.

2. The method as claimed in claim 1, wherein said timer for the forcible cutting of the yarn is set so that the cutting is effected just after starting of the winding drum.

3. The method as claimed in claim 1, wherein the insertion of the yarn to the detecting device by the first suction arm is accomplished by steps comprising turning and moving the yarn on the side of the package to the outside of the splicing apparatus and detecting device by the first suction arm, guiding it by inclined faces of a stationary guide and turning guides and fitting it in guide grooves of the turning guides between which the detecting device is disposed.

4. The method as claimed in claim 1, wherein said yarn splicing operation is performed by applying a compressed fluid to the untwisted and overlapped yarn ends.

5. A splicing appartus provided with means for preventing abnormal splicing in a winder including a first suction arm for a yarn on a package side, a second suction arm for a yarn on a bobbin side and a splicing apparatus, said means for preventing abnormal splicing comprising a detecting device having a cutter, a stationary guide arranged on one end of the detecting device, turning guides arranged on both the sides of the detecting device and electric means for splicing and cutting operation, each of said suction arms being turned and moved to the outside of the splicing apparatus respectively and said splicing apparatus comprising a splicing member having a jetting hole located substantially at the center, a clamping device arranged on the side of the splicing member and expanded in a bifurcate manner to both the sides of the splicing member, yarn control nozzles arranged on both sides of the bifurcate portion of the clamping device, a yarn gathering lever arranged to confront the clamping device through the intervening splicing member, yarn cutting devices arranged outwardly of the control nozzles and a yarn supporting device arranged outwardly of the cutting devices to support the yarn on the side of the bobbin and the yarn on the side of the package, respectively.

6. A method for eliminating abnormal yarn splices in a yarn winding device of the type in which yarn is wound from a bobbin to a package having a first yarn end, the bobbin having a second yarn end, and a splicing means for joining said yarn ends, said method comprising the steps of:

introducing said yarn ends into said splicing means;

monitoring said first yarn end to detect an abnormality therein;

cutting said first yarn end in response to the detection of an abnormality in said first yarn end to remove a portion thereof;

splicing said cut first yarn end together with said second yarn end;

winding said spliced yarn onto said package;

subsequently cutting said spliced yarn in response to the previous detection of said abnormality in said first yarn end to thereby form new yarn ends;

introducing said new yarn ends into said splicing means; and splicing said new yarn ends together.

7. A method for eliminating abnormal yarn splices in a yarn winding apparatus which comprises a package, a bobbin, a first yarn end on the package side, a second yarn end on the bobbin side, and a splicing means for joining said yarn ends together, said method comprising the steps of:

introducing said first and second yarn ends into said splicing means;

monitoring said first yarn end to detect an abnormality therein;

cutting said first yarn end in response to said detection of an abnormality in said first yarn end to thereby create a detached portion of said first yarn end and an undetached portion of said first yarn end;

removing said detected portion of said first yarn end;

splicing together said undetached portion of said first yarn end and said second yarn end in said splicing means;

initiating winding of said spliced yarn onto said package;

cutting said spliced yarn substantially simultaneously with the initiation of said winding step to thereby form two new yarn ends;

introducing said two new yarn ends into said splicing means; and splicing together said two new yarn ends in said splicing means.

8. In a yarn winding device in which yarn is wound from a bobbin onto a package, an apparatus for eliminating abnormal yarn splices between a first yarn end on the package side and a second yarn end on the bobbin side, said apparatus comprising:

splicing means for joining said yarn ends together;

means for introducing said first and second yarn ends into said splicing means;

means for detecting an abnormality in said first yarn end;

means for cutting said first yarn end in response to the detection of an abnormality in said first yarn end to thereby create a detached portion of said first yarn end and an undetached portion of said first yarn end;

means for removing said detached portion of said first yarn end;

means for splicing together said undetached portion of said first yarn end and said second yarn end;

means for initiating winding of said spliced yarn onto said package;

means for cutting said spliced yarn substantially simultaneously with the initiation of said winding step to thereby form two new yarn ends;

means for introducing said two new yarn ends into said splicing means; and means for splicing together said two new yarn ends.

* * * * *